United States Patent [19]

Fairbanks

[11] Patent Number: 4,609,187

[45] Date of Patent: Sep. 2, 1986

[54] POSITIONING APPARATUS

[75] Inventor: David W. Fairbanks, South Brunswick, N.J.

[73] Assignee: RCA Corporation, Princeton, N.J.

[21] Appl. No.: 637,080

[22] Filed: Aug. 2, 1984

[51] Int. Cl.[4] ..... B25B 11/00

[52] U.S. Cl. ..... 269/8; 269/70; 269/71; 269/238; 269/254 R; 269/296

[58] Field of Search ..... 269/8, 70, 71, 74, 126, 269/236, 238, 296, 304, 902, 254 R

[56] References Cited

U.S. PATENT DOCUMENTS

| | | | |
|---|---|---|---|
| 2,436,423 | 2/1948 | Dowd et al. | 269/238 |
| 2,731,992 | 1/1956 | Lozon | 269/70 |
| 2,869,597 | 1/1959 | Lozon | 269/70 |
| 3,108,792 | 10/1963 | Martin | 269/70 |
| 4,454,689 | 6/1984 | Giebmanns | 269/902 |

*Primary Examiner*—Frederick R. Schmidt
*Assistant Examiner*—Judy J. Hartman
*Attorney, Agent, or Firm*—Birgit E. Morris; Donald S. Cohen; James M. Trygg

[57] ABSTRACT

An apparatus for rapidly and accurately positioning and holding a very small elongated body, such as a stylus holder during manufacturing is disclosed. A pair of magnets or magnetized regions are utilized to position the stylus holder both rotationally and axially. A pusher mechanism, in conjunction with a pair of locating blocks very precisely aligns the stylus holder, causing it to engage the seat of an anvil for support during the manufacturing operation. A retaining mechanism retains the stylus holder within the apparatus until completion.

6 Claims, 7 Drawing Figures

POSITIONING APPARATUS

The present invention relates to positioning apparatus for accurately positioning small parts for performing manufacturing operations thereon.

BACKGROUND OF THE INVENTION

Audio and video playback systems of the type using an information-containing-disc having recorded information signals encoded into a fine spiral track typically utilize a stylus to read the encoded information signals. Included in such systems are the capacitive playback systems, wherein the stylus dielectric material is coated on at least one surface with a conductive metal layer which interacts with the conductive disc to read the information encoded thereon. An example of such a system is disclosed in U.S. Pat. No. 3,842,194 issued Oct. 15, 1974 to Clemens. Clemens discloses a video disc having a playback system utilizing variable capacitance. In one configuration of the Clemens system, information representative of recorded picture and sound is encoded in the form of a relief pattern in a relatively fine spiral groove on the surface of the disc. For example, groove widths of about 2.5 micrometers and groove depths of about 1.0 micrometer may be used. During playback a pickup stylus having a shoe width of 2.0 micrometers and a thin conductive electrode formed thereon, for example about 0.2 micrometers thick, engages the groove as the record is rotated by a supportive turntable. Capacitive variations between the stylus electrode and the disc surface are sensed to recover the pre-recorded information. In systems of the above type, the use of a relatively fine record groove and the requirements for a groove engaging pickup stylus result in a stylus tip which is extremely small.

During the manufacturing of stylus holders containing such styli, the stylus holder must be very accurately aligned and retained in position during various operations such as insertion of the stylus. A pilot hole may be drilled through the stylus holder and the stylus inserted into the hole or the stylus may be made to pierce the stylus holder without a pilot hole. Further, a plastic end piece may be crimped to the stylus holder for receiving the stylus. All of these operations require that the stylus holder be very accurately aligned to minimize tolerance buildup and assure that the completed stylus holder containing the stylus will function as intended.

The procedures required to accomplish this are complex and time consuming to carry out when using conventional tooling and require a highly skilled operator to achieve an acceptable level of repeatability. The present invention, however, through the use of novel mechanisms, permits an operator of less skill to very rapidly align a stylus holder, of the type herein described, within required limits preparatory to carrying out a particular manufacturing operation.

SUMMARY OF THE INVENTION

According to the present invention there is shown an apparatus for positioning and holding an elongated body during manufacturing thereof where the elongated body includes a longitudinal axis and a magnetized region. An anvil is provided for supporting a first portion of the elongated body. A support plate is also provided that is selectively movable in a direction toward the anvil to a first position and away from the anvil to a second position. A guide means interacting with the magnetized region positions the elongated body so that when the support plate is in the first position, the first portion of the body is in supported engagement with the anvil and when the support plate is in the second position the first portion of the body is spaced from the anvil.

DESCRIPTION OF THE PREFERRED EMBODIMENT

Figure 1:
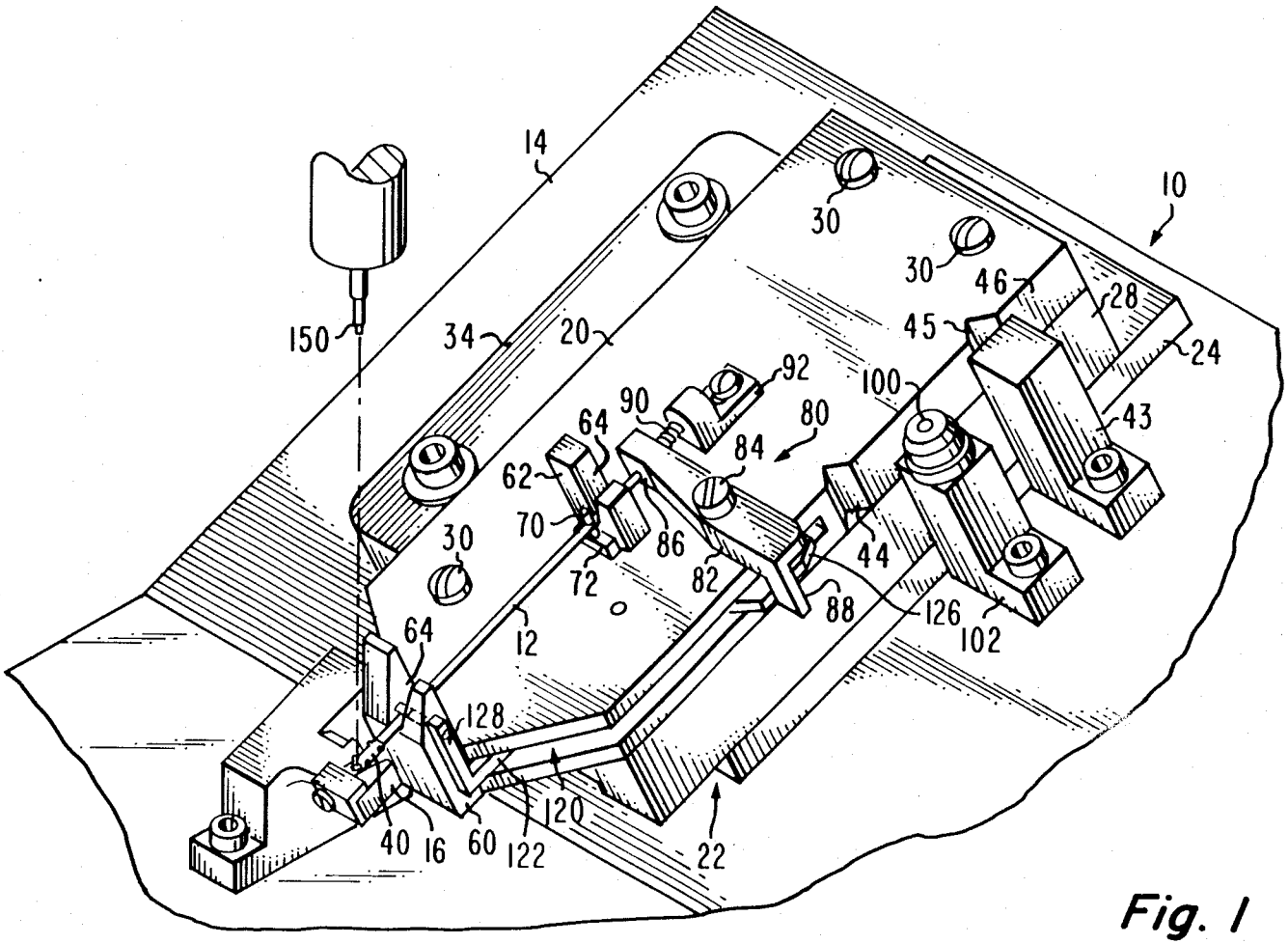
FIG. 1 is an isometric view of the positioning apparatus embodying the teachings of the present invention.

FIGS. 1 through 5 show a positioning apparatus 10 for positioning an elongated body 12. In the present case the body 12 is a stylus holder for holding styli of the type used to read encoded information signals that are recorded into the track of an audio or video disc. The apparatus 10 includes a frame 14, an anvil 16 which is attached to the frame, and a movable support plate 20. A standard commercially available slide 22 has a stationary portion 24 which is secured to a surfce 26 of the frame 14 and a moving portion 28 that is arranged to slide in a direction toward and away from the anvil 16, as shown in FIGS. 3*a*, 3*b*, and 3*c*. The support plate 20 is attached to the moving portion 28 of the slide 22 by screw fasteners 30. A tab 32 projects outwardly from one side of the support plate 20 as viewed in FIG. 3*a*. A u-shaped bracket 34 is attached to the surface 26 and is arranged to limit movement of the support plate by engaging the tab 32. A pair of set screws 36, which are threaded into each end of the bracket 34, may be adjusted to very accurately determine the extent of travel of the support plate 20 toward and away from anvil 16. The support plate 20 has a pair of depressions, or v-grooves, in an edge 46. A detent consisting of a spring loaded ball 42 is held within a bracket 43 which is adjustably attached to the surface 26. The spring loaded ball 42 engages either of the pair of depressions 44 and 45 and is arranged so that the support plate 20 is held in its retracted position, as shown in FIG. 3*a*, or in its fully extended position, as shown in FIG. 3*c*.

Figure 4:
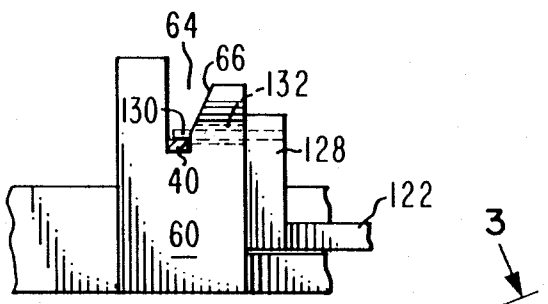
FIG. 4 is a view taken along the lines 4—4 of FIG. 2.
Figure 2:
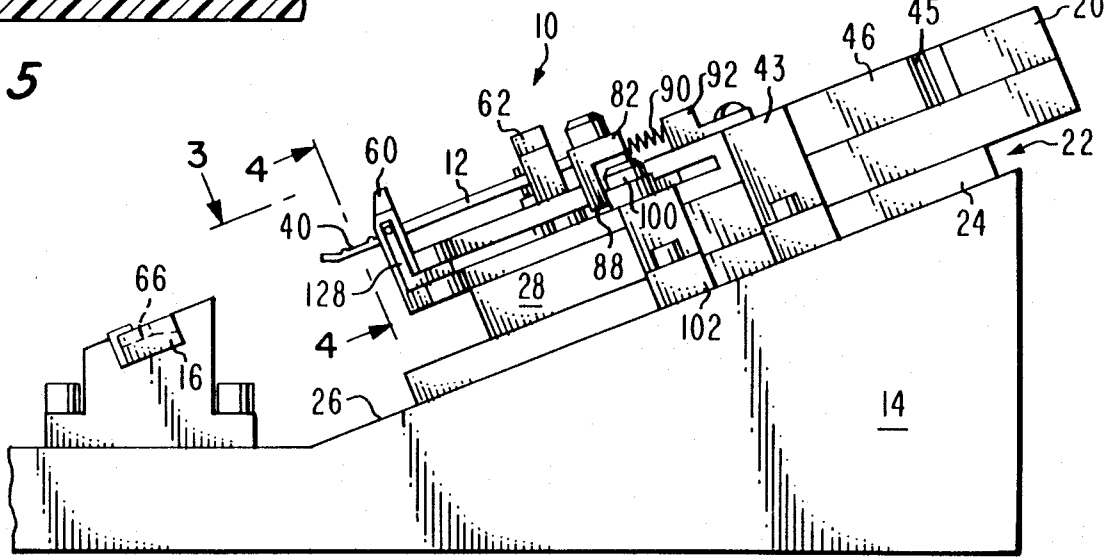
FIG. 2 is a side elevation view of the apparatus shown in FIG. 1.

A first locating block 60 is attached to the front of the support plate 20 and a second locating block 62 is attached to the support plate 20 spaced from the block 60 and in alignment therewith, as shown in FIGS. 1 and 2. The blocks 60 and 62 each contain a guide slot 64 having a chamfered side 66, as best seen in FIG. 4. The slot 64 is only wide enough to permit the stylus holder 12 to fully enter and engage the bottom of the slot without appreciable side movement. The slots 64 are in alignment with a seat 66 disposed in the anvil 16 so that when the stylus holder 12 is placed within the slots 64, the longitudinal axis of the stylus holder 12 is also in alignment with the seat 66.

Figure 5:
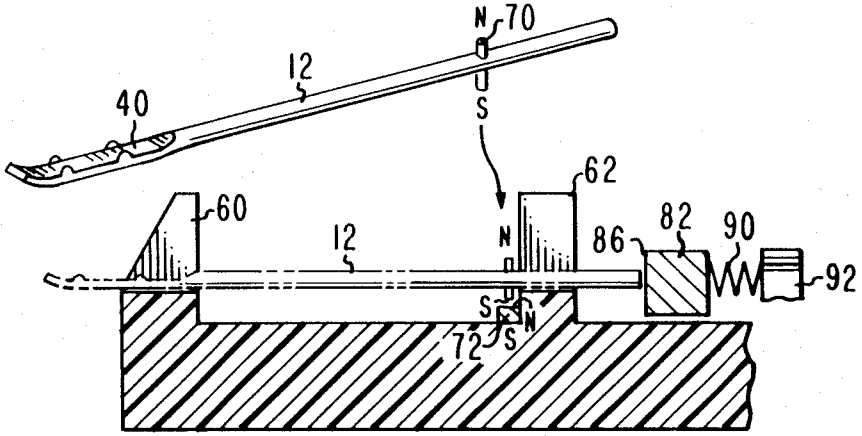
FIG. 5 is a cross sectional view taken along the lines 5—5 of FIG. 3*a*.

A small bar magnet 70 projects through an opening in the stylus holder 12, as best seen in FIG. 5, so that its north/south polar axis is perpendicular to the longitudinal axis of the holder 12. Instead of the bar magnet 70, a magnetized region having north and south poles could be provided in the stylus holder 12 in which case the poles of which may or may not straddle the longitudinal axis of the stylus holder 12. A bar magnet 72 is attached to the support plate adjacent the locating block 12 with its north pole facing upwardly, as shown in FIG. 5. When the stylus holder 12 is placed within the slots 64, the mutual attraction of the two magnets 70 and 72 will cause the stylus holder to move into proper alignment.

A pusher mechanism 80 is arranged to urge the stylus holder 12 toward the anvil 16 a small amount. The pusher 80 includes an arm 82 which is pivotally attached to the support plate 20 at 84. The arm 82 includes an abutting surface 86 at one end and a tab 88 at the other end thereof. A spring member 90, secured to the support plate 20 by a bracket 92, pushingly engages the arm 82 opposite the abutting surface 86, thereby urging the stylus holder 12 toward the anvil 16. A stop roller 100 is rotationally attached to a bracket 102 which in turn is adjustably attached to the surface 26 of the frame 14. The bracket 102 is positioned so that when the support plate 20 is in its fully retracted position, as shown in FIG. 3*a*, the stop roller 100 is in engagement with the tab 88 causing the abutting surface 86 to be spaced a small distance from the end 110 of the stylus holder 12.

Figure 3C:
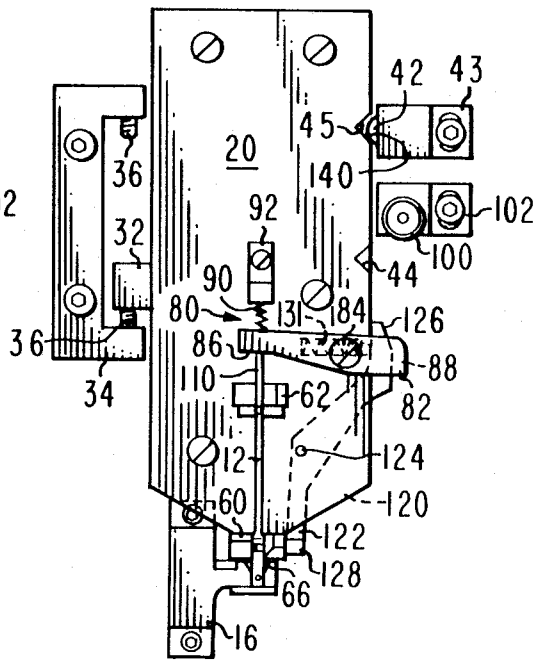
FIG. 3*c* is similar to FIG. 3*a* showing the support plate fully extended.
Figure 3B:
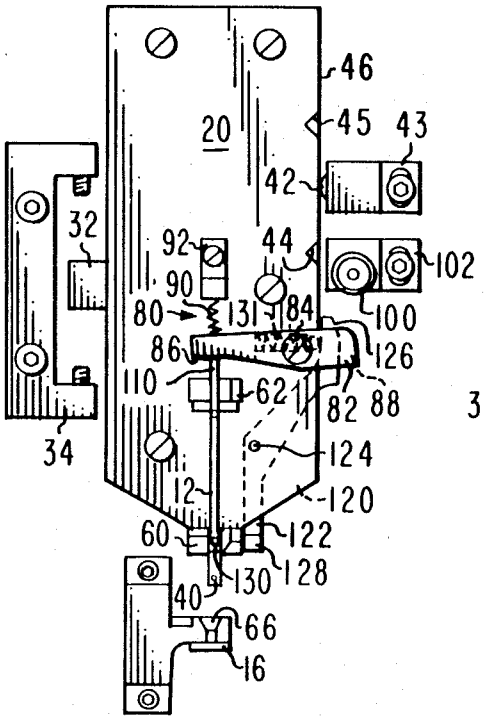
FIG. 3*b* is similar to FIG. 3*a* showing the support plate in an intermediate position.

The support plate 20 includes a clearance slot 120 within which a retainer pin arm 122 is disposed. The retainer pin arm 122 is pivoted about the pin 124 and includes a camming surface 126 at one end and an upwardly turned tab 128 at the opposite end adjacent the locating block 60. A retainer pin 130 projects outwardly from the tab 128 in a direction perpendicular to the longitudinal axis of the stylus holder 12, as shown in FIGS. 3*a*–3*c*. The retainer pin 130 projects through a clearance hole 132 in the locating block 60 and is arranged so that when the retainer pin arm 122 is pivoted to the position indicated in FIG. 3*c*, the end of the pin 130 will extend over and retain the end portion 40 of the stylus holder 12 within the slot 64, as best seen in FIG. 4. A resilient member 131 presses against the retainer pin arm 122 opposite the camming surface 126 and urges the arm 122 into this position. When the support plate 20 is in its fully retracted position, as shown in FIG. 3*a*, the stop roller 100 is in engagement with the camming surface 126 causing the retainer pin arm 122 to pivot to a position wherein the retainer pin 130 is completely withdrawn from the slot 64.

Figure 3A:
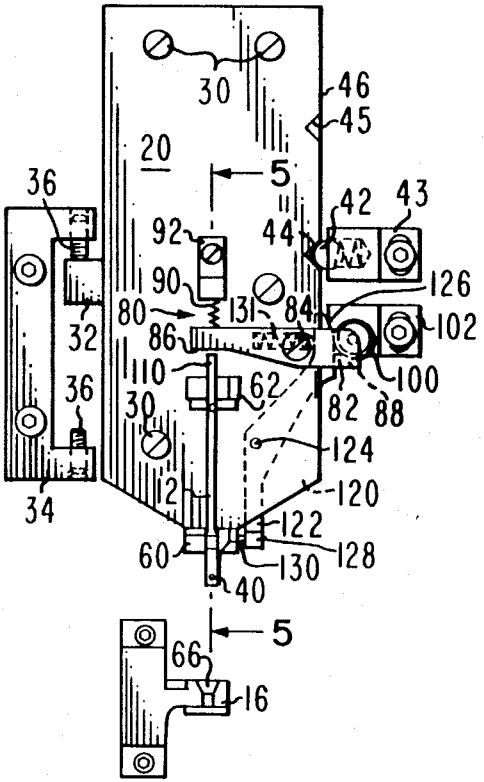
FIG. 3*a* is a view taken along the lines 3—3 of FIG. 2 showing the support plate fully retracted.

In operation, the support plate 20 is retracted away from the anvil 16 to the position shown in FIG. 3*a* where the spring loaded ball 42 is in engagement with the most forward V-groove 44. A stylus holder 12 is manually placed within the openings of the two slots 64 and allowed to fall completely into the slots as shown in FIG. 5. As the stylus holder 12 engages the slot 64, the magnet 70 will be attracted to the north pole of the other magnet 72 thereby causing the stylus holder 12 to rotate within the slots 64 until the two magnets are in alignment as shown in FIG. 5. Should the stylus holder 12 be displaced somewhat to the right or left as it is being placed within the slots 64, as viewed in FIG. 5, the mutual attraction of the two magnets 70 and 72 will cause the stylus holder to move into proper alignment.

The support plate 20 is then caused to move toward the anvil 16 as shown in FIG. 3*b*. This causes the stop roller 100 to disengage first, from the tab 88 then from the camming surface 126. As the roller 100 disengages the tab 88, the arm 82 pivots under the urging of the spring 90 and the abutting surface 86 contacts the end 110 of the stylus holder 12. The stylus holder is thereby urged forward toward the anvil 16 a small amount, as shown in FIG. 3*b*. The roller 100 then disengages the camming surface 126. This permits the retainer pin arm 122 to pivot under the urging of the resilient member 131 so that the retainer pin 130 invades the slot 64 directly above the end portion 40. This effectively retains the end portion 40 of the stylus holder 12 within the slot 64 as shown in FIG. 4.

Movement of the support plate 20 continues until the tab 32 engages the stop set screw 36 whereupon the spring loaded ball 42 engaged the forward most edge 140 of the V-groove 45 thereby maintaining the tab 32 in contact with the set screw 36, see FIG. 3*c*. As the support plate 20 approaches this fully extended position, as shown in FIG. 3*c*, the end portion 40 engages the seat 66 of the anvil 16. As the end portion 40 of the stylus holder 12 properly seats, further movement of the support plate 20 toward the anvil will not produce further movement of the stylus holder 12. Such further movement will cause the arm 82 to pivot clockwise a small amount in opposition to the spring 90, as shown in FIG. 3*c*, thereby firmly holding the end portion 40 within the seat 66.

With the end portion 40 of a stylus holder 12 properly positioned and firmly held in place within the seat 66 of the anvil 16, the end portion 40 may undergo various drilling, stamping, swaging, or stylus inserting operations by a suitable tool 150 which is schematically depicted in FIG. 1.

When the desired manufacturing operation is complete, the support plate 20 is fully retracted to the position shown in FIG. 3*a* and the stylus holder 12 removed. The cycle may then be repeated.

A very significant advantage inherent in the teachings of the present invention is the ease with which a stylus holder is very accurately and rapidly positioned within the positioning apparatus. The novel use of the magnets 70 and 72 assure that the stylus holder is automatically and properly oriented prior to engagement with the anvil. Further, the novel pusher mechanism 80, the retainer pin arm 122, and the pin 130 assure that proper engagement of the stylus holder with the anvil occurs. This effectively reduces the operator skill level necessary to reliably position and hold the stylus holder in carrying out various manufacturing operations thereon.

I claim:

1. An apparatus for positioning and holding an elongated body during manufacturing thereof, wherein said elongated body includes a longitudinal axis and a magnetized region, said apparatus comprising:

a. an anvil for supporting an end portion of said elongated body;

b. a support plate selectively movable in a direction toward said anvil to a first position and away from said anvil to a second position;

c. means interactive with said elongated body for positioning thereof so that when said support plate is in said first position said end portion of said body is in supported engagement with said anvil, and when said support plate is in said second position said end portion of said body is spaced from said anvil, wherein said means for positioning said elongated body comprises:

c1. a positioning block attached to said support plate having a guide slot arranged to laterally align said longitudinal axis of sid elongated body with respect to said anvil;

c2. coupling means for rotationally aligning said elongated body about said longitudinal axis with respect to said anvil comprising a magnetic pole fixed with respect to said support plate and adapted to react with said magnetized region of said elongated body so that when said elongated body is in said guide slot of said positioning block said magnetized region will uniquely align itself with said magnetic pole;

c3. pusher means for axially aligning said elongated body along said longitudinal axis with respect to said anvil; and c4. retaining means for retaining said elongated body within said positioning block.

2. The apparatus set forth in claim 1 wherein said magnetic pole is a pole of a permanent magnet.

3. The apparatus set forth in claim 2 wherein said pusher means comprises an arm movably attached to said support plate, an abutting surface on said arm, resilient means for urging said abutting surface against said elongated body so that when said support plate is in said first position said end portion of said elongated body is urged into engagement with said anvil for said supporting thereby, and means for urging said abutting surface out of said engagement when said support plate is in said second position.

4. The apparatus set forth in claim 3 wherein said arm is pivotally attached to said support plate.

5. The apparatus set forth in claim 4 wherein said abutting surface is movable against the urging of said resilient member by said elongated body upon engagement of said end portion with said anvil.

6. The apparatus set forth in claim 5 wherein said permanent magnet is arranged so that its polar axis is substantially perpendicular to said longitudinal axis of said elongated body.

* * * * *